US005943840A

United States Patent [19]

Nilsson et al.

[11] Patent Number: 5,943,840

[45] **Date of Patent: *Aug. 31, 1999**

[54] METHOD AND APPARATUS FOR FORMING THE TOP OF A CONTAINER WITH A FITMENT THEREON

[75] Inventors: Jan-Östen Nilsson, Palatine; Göran Petersson, Wheeling; Jens Mogard, Buffalo Grove, all of Ill.

[73] Assignee: Tetra Laval Holdings & Finance, SA, Pully, Switzerland

[ * ] Notice: This patent is subject to a terminal disclaimer.

[21] Appl. No.: 09/191,167

[22] Filed: Nov. 13, 1998

Related U.S. Application Data

[60] Continuation-in-part of application No. 09/150,482, Sep. 9, 1998, Pat. No. 5,867,966, which is a division of application No. 08/922,197, Sep. 2, 1997, Pat. No. 5,829,228, which is a continuation-in-part of application No. 08/639,162, Apr. 25, 1996, Pat. No. 5,704,541.

[51] Int. Cl.[6] ..... B65B 61/20

[52] U.S. Cl. ..... 53/133.2; 53/243; 53/563; 493/105; 493/165; 493/175; 493/184

[58] Field of Search ..... 53/133.2, 575, 53/410, 412, 458, 459, 467, 477, 484, 563, 565, 242, 243; 493/102, 962, 103, 105, 106, 163, 164, 165, 175, 176, 177, 178, 179, 180, 181, 182, 183, 184, 185

[56] References Cited

U.S. PATENT DOCUMENTS

| | | | |
|---|---|---|---|
| 3,119,543 | 1/1964 | Walker | 53/133.2 |
| 3,789,746 | 2/1974 | Martensson et al. | 53/563 |
| 4,456,118 | 6/1984 | Kauffman et al. | 53/565 |
| 4,604,850 | 8/1986 | Reil | 53/563 |
| 4,738,811 | 4/1988 | Kawajiri et al. | 53/133.2 |
| 4,790,123 | 12/1988 | Ljungstrom et al. | 53/563 |
| 5,058,360 | 10/1991 | Yamazaki et al. | 53/133.2 |
| 5,276,934 | 1/1994 | Pape et al. | 53/133.2 |
| 5,484,374 | 1/1996 | Bachner et al. | 53/133.2 |
| 5,492,592 | 2/1996 | Bergholtz et al. | 53/133.2 |
| 5,716,471 | 2/1998 | Pape | 53/133.2 |

FOREIGN PATENT DOCUMENTS

| | | | |
|---|---|---|---|
| 406001305 | 1/1994 | Japan | 53/133.2 |

*Primary Examiner*—Jessica J. Harrison
*Assistant Examiner*—John Paradiso

[57] ABSTRACT

The present invention forms and seals the top end of a container prior to filling and bottom sealing. The top end may have a fitment attached thereon at a variety of different positions on a form, fill and seal packaging machine. The fitment may be a screw cap, a push-in, a flip-cap type or similar fitments. The container may be a flat top, tetrahedral or similar type container. The fitment may be applied on the exterior or the interior of the container.

14 Claims, 6 Drawing Sheets

METHOD AND APPARATUS FOR FORMING THE TOP OF A CONTAINER WITH A FITMENT THEREON

CROSS REFERENCES TO RELATED APPLICATIONS

This application is a continuation-in-part application of U.S. patent application Ser. No. 09/150,482, filed Sep. 9, 1998, now U.S. Pat. No. 5,867,966 which is a divisional application of U.S. patent application Ser. No. 08/922,197, filed on Sep. 2, 1997, now U.S. Pat. No. 5,829,228, which is a continuation-in-part of U.S. patent application Ser. No. 08/639,162, filed on Apr. 4, 1996 and now U.S. Pat. No. 5,704,541.

STATEMENT REGARDING FEDERALLY SPONSORED RESEARCH OR DEVELOPMENT

Not Applicable

BACKGROUND OF THE INVENTION

1. Field of the Invention

The present invention relates to a method and apparatus for forming the top of a container. Specifically, the present invention relates to a method and apparatus for forming the top of a container on a mandrel wheel of a form, fill and seal packaging machine.

2. Description of the Related Art

Many varieties of single-use containers exist for the packaging of liquids, powders or the like. The liquids may include milk or juice. The containers may be formed from blanks or sheets made of a variety of laminate materials having a substrate such as paperboard, strawboard, pasteboard, cardboard, and the like. The substrate may be laminated with a thermoplastic or similar liquid resistant coating to enable the container to retain liquids. The blanks may be folded into a variety of container cross-sections, such as tubular, rectangular, square, octagonal, hexagonal, and the like.

Traditionally, milk has been packaged in gable-top cartons that are torn open to reveal an integrated pouring device for accessing the product. Most recently, juice, such as orange juice, packaged in gable-top cartons with a fitment attached for accessing the product has gained favor with the consumer.

However, gable-top cartons have limitations that are dependent upon the circumstances. Gable-top cartons waste an enormous amount of material to form the gable-top that before the advent of fitments, and the technology for applying them, was necessary to access the product. Currently, with the popularity of fitments, the gable-top has become a non-functional aesthetic component of cartons.

Conventional containers have been proposed with flat upper ends having a spout and cap opening in the center of the top. However, flat-ended containers experience other limitations. In flat-ended containers, the adjoining edges of the folded end panels produce seams. These seams expose edges of the paperboard substrate material to the liquid product within the container. The product undergoes a wicking or capillary action and is soaked into the paperboard core of the container thereby degrading the seals and compromising the integrity of the package. In addition, conventional flat-ended containers are unable to achieve a hermetic seal along the seams produced at the upper end of the container. Thus, while conventional flat-ended containers are liquid tight, such containers are not hermetically sealed and, therefore, are unable to maintain a pressurized interior chamber, such as is required to preserve carbonated liquids. In addition, the non-hermetic seams in conventional paperboard-based containers are an unsatisfactory medium for storing liquids which are highly sensitive to oxygen, such as wine, orange juice, or the like.

A further problem has been forming containers without a top fin seal most readily apparent on a gable-top carton. For the most part, traditional form, fill and seal carton packaging machines do not lend themselves to high production of non-gable-top cartons. Some machines may flatten and seal the gable-top to provide an appearance of a flat top carton; however, this does not resolve the inefficient use of material.

BRIEF SUMMARY OF THE INVENTION

The present invention resolves the problems of the prior art by providing a novel method and apparatus for forming containers. The present invention accomplishes this by first forming the top end of the container, then filling, and then sealing the bottom end of the container.

One aspect of the present invention is a packaging machine having a mandrel wheel with a plurality of mandrels thereon. Each mandrel accepts a carton for sealing of the top end before attaching a fitment to the exterior panels while on the mandrel. The fitment may be attached by ultrasonic sealing, hot melt sealing or induction heat sealing (if an appropriate carton blank is utilized). The fitment may be configured to greatly modify the appearance of the top of the carton. Once the fitment is applied, the carton is discharged from the mandrel to a conveyor for further processing on the packaging machine, such as sterilization, filling and sealing of the bottom end. The conveyor is capable of accepting and transporting a carton with a fitment thereon wherein the bottom end of the carton is open for filling.

Another aspect of the present invention is a method for sealing the top end of a carton and applying a fitment thereto on a mandrel prior to filling through the bottom end of the carton.

Another aspect of the present invention is a container form by the method of the present invention. The container may have a non-gable top end that could be a number of different styles such as tetrahedral top, flat top, and the like depending on the shape of the fitment.

It is a primary object of the present invention to provide a method and apparatus for forming a flat top carton with a fitment thereon.

It is an additional object of the present invention to provide a method and apparatus for attaching a fitment to a container being fabricated on mandrel wheel.

It is an additional object of the present invention to provide a method and apparatus for forming a container with a distinctive fitment top.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 2E is an isolated side view of a carton at the fitment application station of the mandrel assembly of FIG. 2.

FIG. 2F is an isolated view of an alternative fitment dispenser for the present invention.

FIG. 3 is an isolated view of a mandrel of the present invention.

FIG. 4 is an isolated top plan view of the conveyor assembly of the present invention.

FIG. 4A is an isolated top perspective view of the conveyor assembly of FIG. 4.

FIG. 5 is a top perspective view of a carton with a fitment thereon produced by the present invention.

FIG. 6 is a side perspective view of a carton with an alternative fitment thereon produced by the present invention.

FIG. 7 is a side perspective view of a carton with an alternative fitment thereon produced by the present invention.

FIG. 8 is a side perspective view of a carton with an alternative fitment thereon produced by the present invention.

FIG. 9 is a top plan view of the carton of FIG. 7 with the fitment thereon.

DETAILED DESCRIPTION OF THE INVENTION

The novelty of the present invention is the forming and sealing of the top end of a container prior to filling and bottom sealing in such a way as to fabricate the novel containers mentioned above. The present invention involves much more than simply switching the top for the bottom. As will be described below, the sealing of the top end first provides numerous opportunities, however, it also necessitates numerous modifications to ensure that the container is sealed as tightly as a bottom first sealed container.

Figure 1:
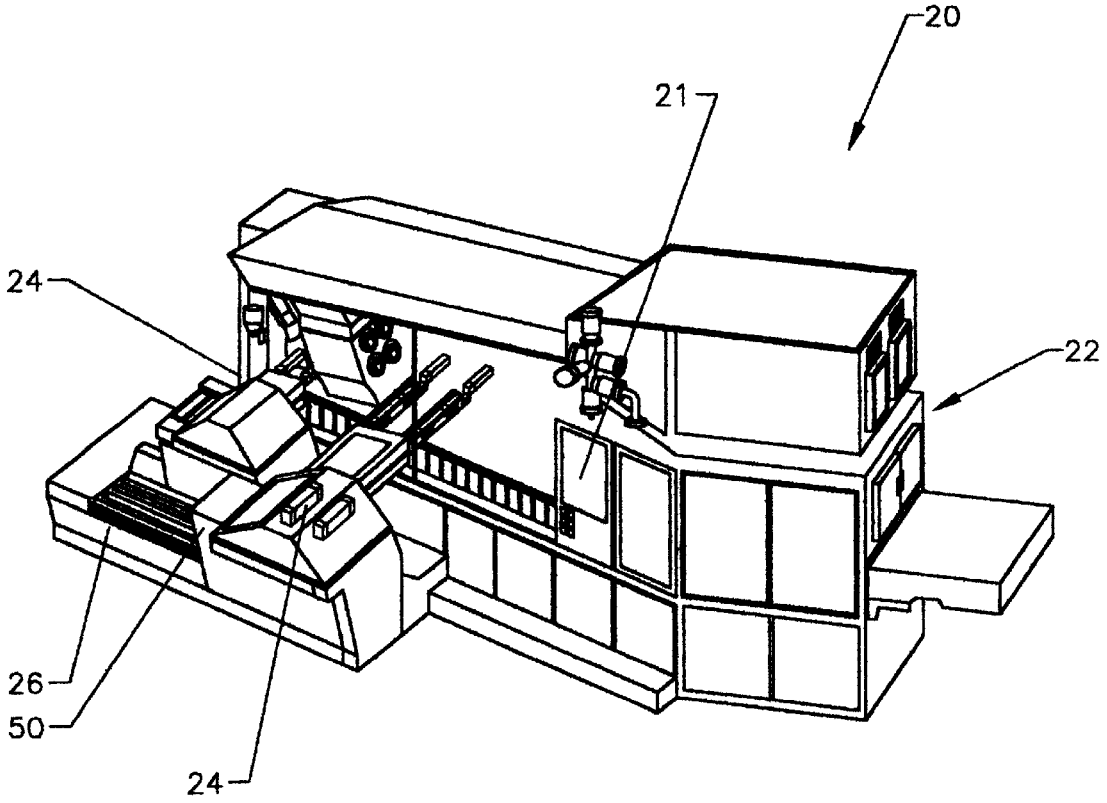
FIG. 1 is a top perspective view of a packaging machine with the present invention integrated thereon.

There is illustrated in FIG. 1 a packaging system generally designated 20. The packaging system 20 includes a packaging machine 22, a carton opener 24, a magazine 26, and optionally an automatic carton loader ("ACL") 28. The packaging machine may be a typical linear form, fill and seal packaging machine such as a TETRA REX® packaging machine available from Tetra Pak Incorporated of Chicago, Ill. The packaging machine 22 may have a programmable logic controller ("PLC") 21 to control the various operations of the packaging system 20. Also, disposed within the packaging machine 22 are a sterilization station 37, a filling station 40 and a sealing station 41.

In operation a plurality of different blanks 30 are transported from the ACL 28 to magazine 26. The blanks 30 are then transferred individually to the carton opener 24 for erection of the blank for placement on a mandrel of the packaging machine 22. After forming and sealing on the mandrel, each carton is transported along the conveyor for eventual filling with a product at a filling station 40 and final sealing at the sealing station 41 to create a formed, filled and sealed container.

Figure 2:
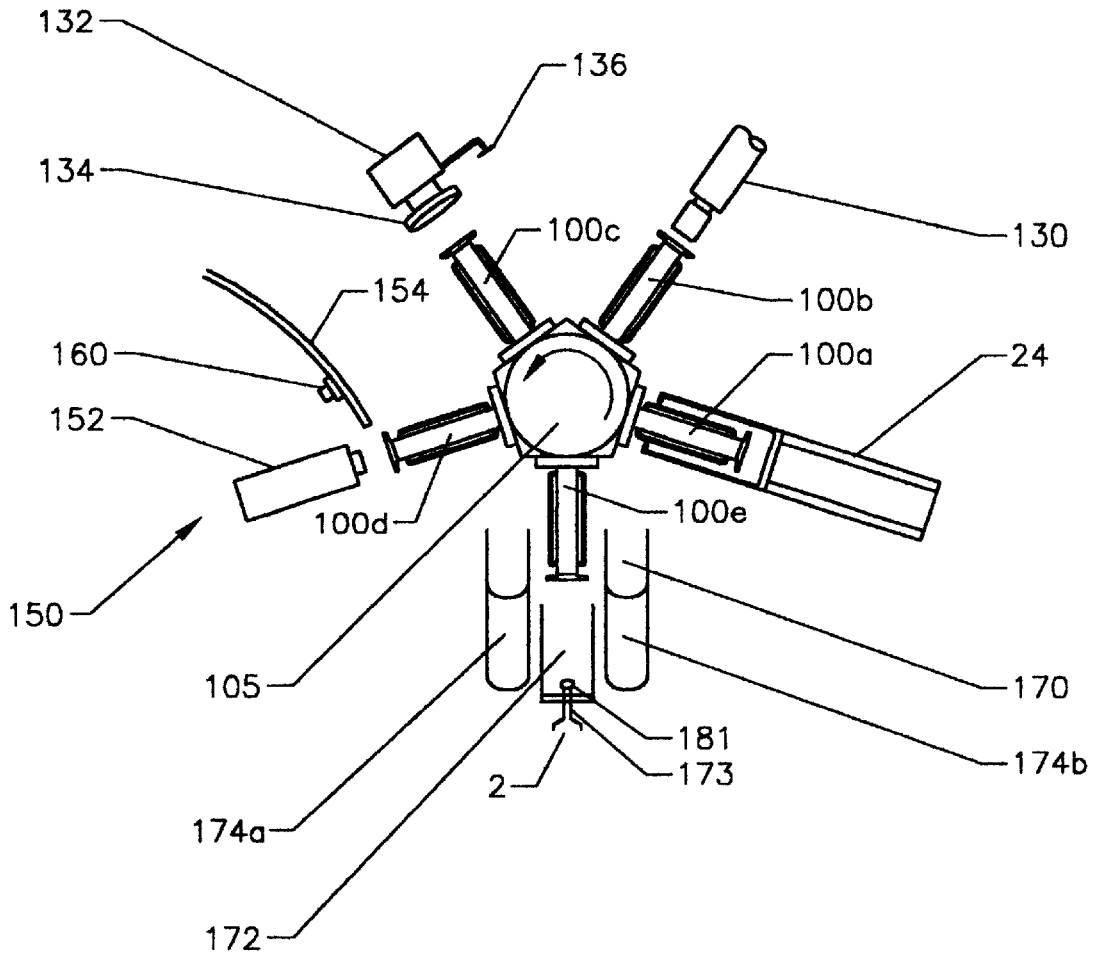
FIG. 2 is a front perspective view of the mandrel assembly of the present invention.

In reference to FIG. 2, although no cartons are shown, each of the unerected carton blanks 30 is discharged from the magazine 26 while simultaneously erected in a tubular form, which may be a square cross-section, however, containers having other cross-sections such as octagonal or hexagonal cross-sections are well-within the scope of the present invention. By means of a carton opener 24, which may be a rotatable chain provided with carriers, the erected package blanks 30 are pushed onto a mandrel 100*a* provided on a multiple mandrel assembly 105. As shown in FIG. 2, the multiple mandrel assembly 105 has five mandrels 100*a–e* projecting outward therefrom.

Figure 2A:
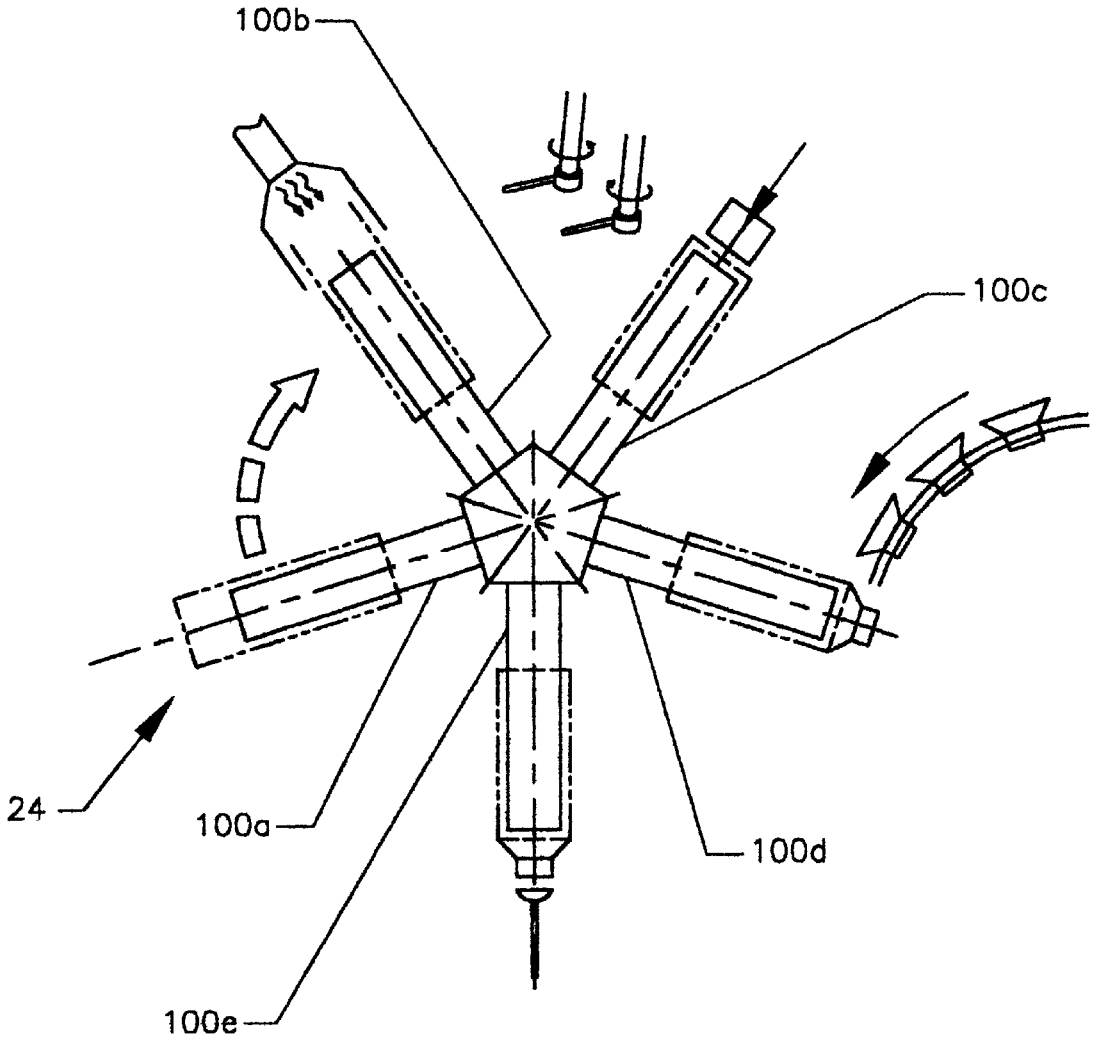
FIG. 2A is a rear view of the mandrel assembly of FIG. 2 with cartons being formed thereon.
Figure 2B:
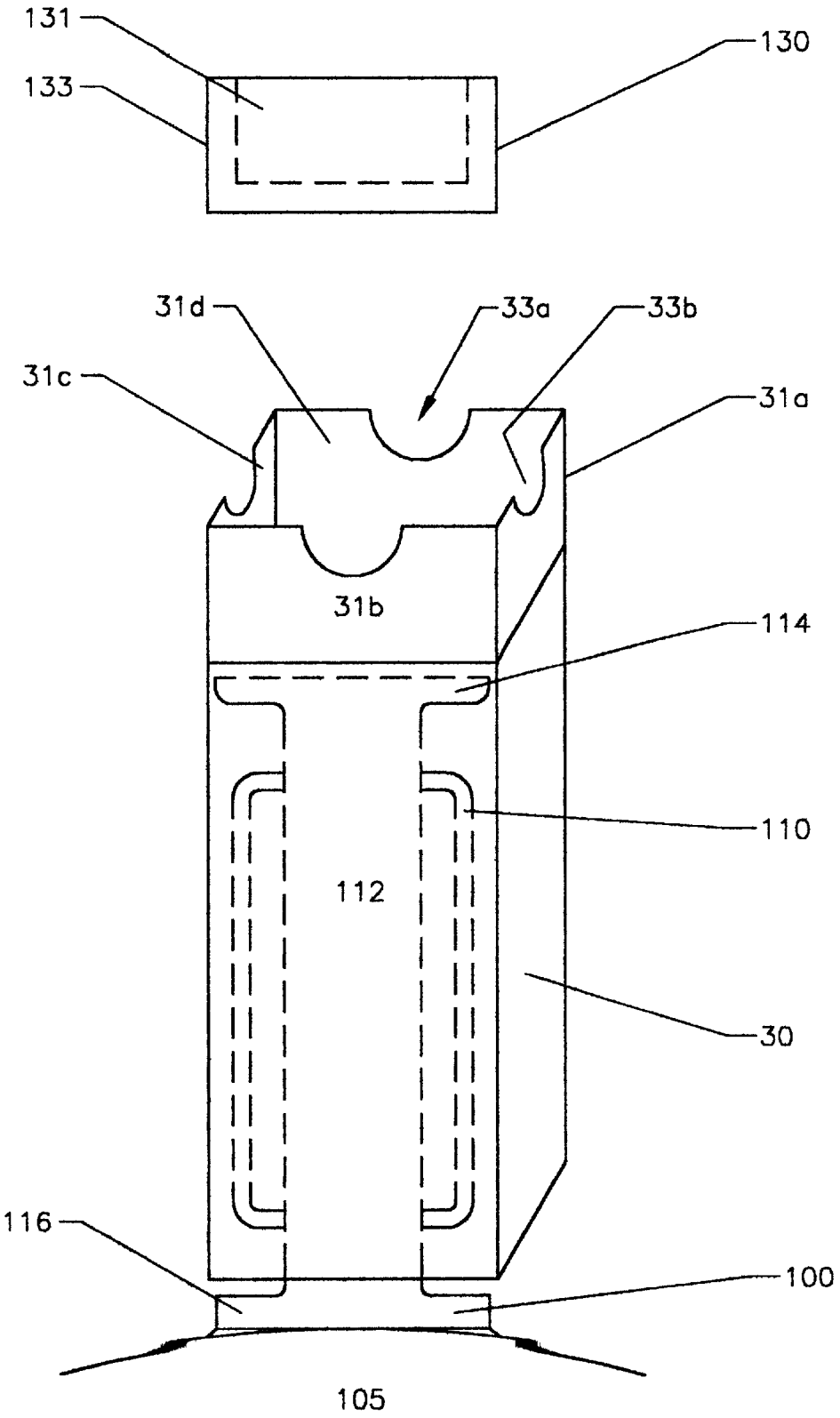
FIG. 2B is an isolated view of a carton at the heating station of the mandrel assembly of FIG. 2.

FIG. 2A shows the rear view of the mandrel assembly 105 of FIG. 2, and also shows cartons being formed on the mandrel assembly 105.

As shown in FIG. 3, each mandrel 100 has a plurality of carton guides 110*a–b* which are attached to a mandrel body 112. On one end of the mandrel body 112 is a plate 114 while on the other end is a mounting 116 for attachment of the mandrel 100 to the mandrel wheel 105. In a preferred embodiment where ultrasonic sealing is utilized, the anvil plate 114 is an ultrasonic anvil plate 114. The ultrasonic anvil plate 114 must be able to withstand the ultrasonic energy transferred from a sonotrode during application of a fitment to a carton 30, as will be described below. The anvil plate 114 should prevent the ultrasonic energy from being transferred to the mandrel wheel 105, and also to the entirety of the machine 22. To insulate the wheel 105 and machine 22 from such energy transference, several insulating components may be added to the anvil plate 114 such as rubber membranes and air gaps. A more thorough description of such insulating components is set forth in U.S. Pat. No. 5,775,055 entitled Ultrasonic Sealing Anvil, which relevant parts are hereby incorporated by reference.

Still referring to FIG. 3, an optional vacuum channel 118 may be provided in each mandrel 100 in order to retain a fitment on a carton 30. The vacuum channel 118 would be in flow communication with a vacuum on one end, and have an aperture 120 through the plate 114 on the other end. Alternatively, a protrusion may be disposed on the plate 114 in order to retain a fitment thereto. If other application means are utilized for attaching the fitment to the carton, the plate 114 must still be able to withstand the top panel sealing pressure exerted by a sealing plate 134.

Figure 2C:
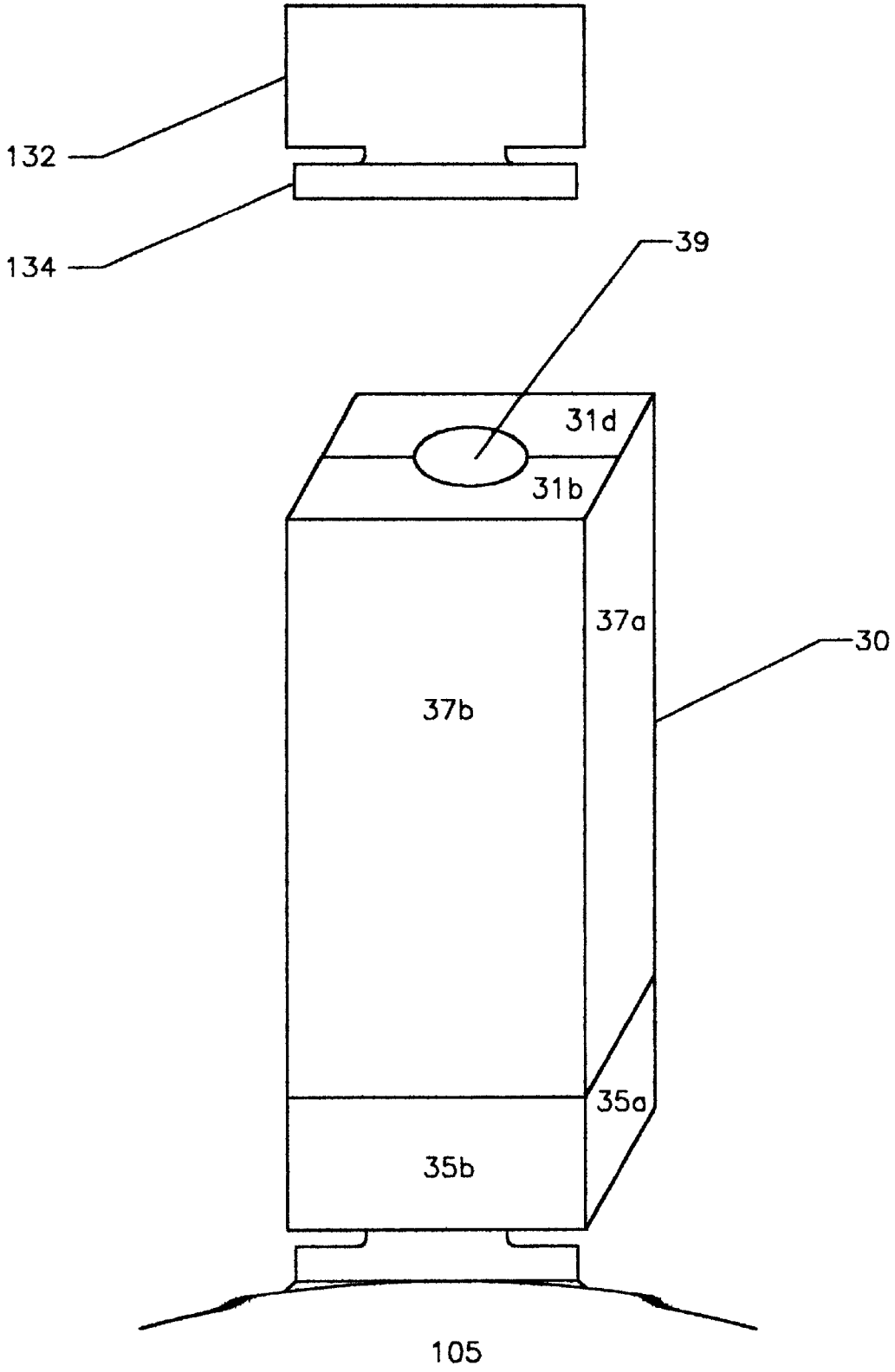
FIG. 2C is an isolated view of a carton at the sealing station of the mandrel assembly of FIG. 2.

Returning to FIG. 2, several operational stations are positioned about the mandrel wheel 105. It should be noted that mandrel wheels 105 with a greater or lesser number of mandrels 100 are well within the scope and spirit of the present invention. The first station after placement of an erected carton blank on the mandrel 100*a* is the heating station 130 where the end panels of the carton 30 are heated in preparation of sealing together to form one end of the carton 30. As illustrated in FIG. 2C, the top panels 31*a–d* of the carton 30 are heated by hot air blower 131 which is encompassed with a perimeter enclosure 133. The hot air blower 131 and enclosure 133 are moved toward the top panels 31*a–d* whereby the panels 31*a–d* are within the enclosure 133. The top panels 31*a–d* will each, respectively, has a cut-out 33*a–d*. The cut-outs 33*a–d* form an access area 39 where upon the fitment is placed as described below.

The sealing occurs at the sealing station 132 where the sealing plate 134 presses the panels together and also cools the previously heated panels. A folding device 136 also folds the end panels. As shown in FIG. 2C, the carton 30 has a flat top with an access area 39 subsequent to sealing by the sealing plate 134. From the sealing station 132, each mandrel 100 is rotated to a fitment application station 150.

The fitment application station 150 may vary from ultrasonic sealing, to hot melt sealing to induction heat sealing.

Figure 2D:
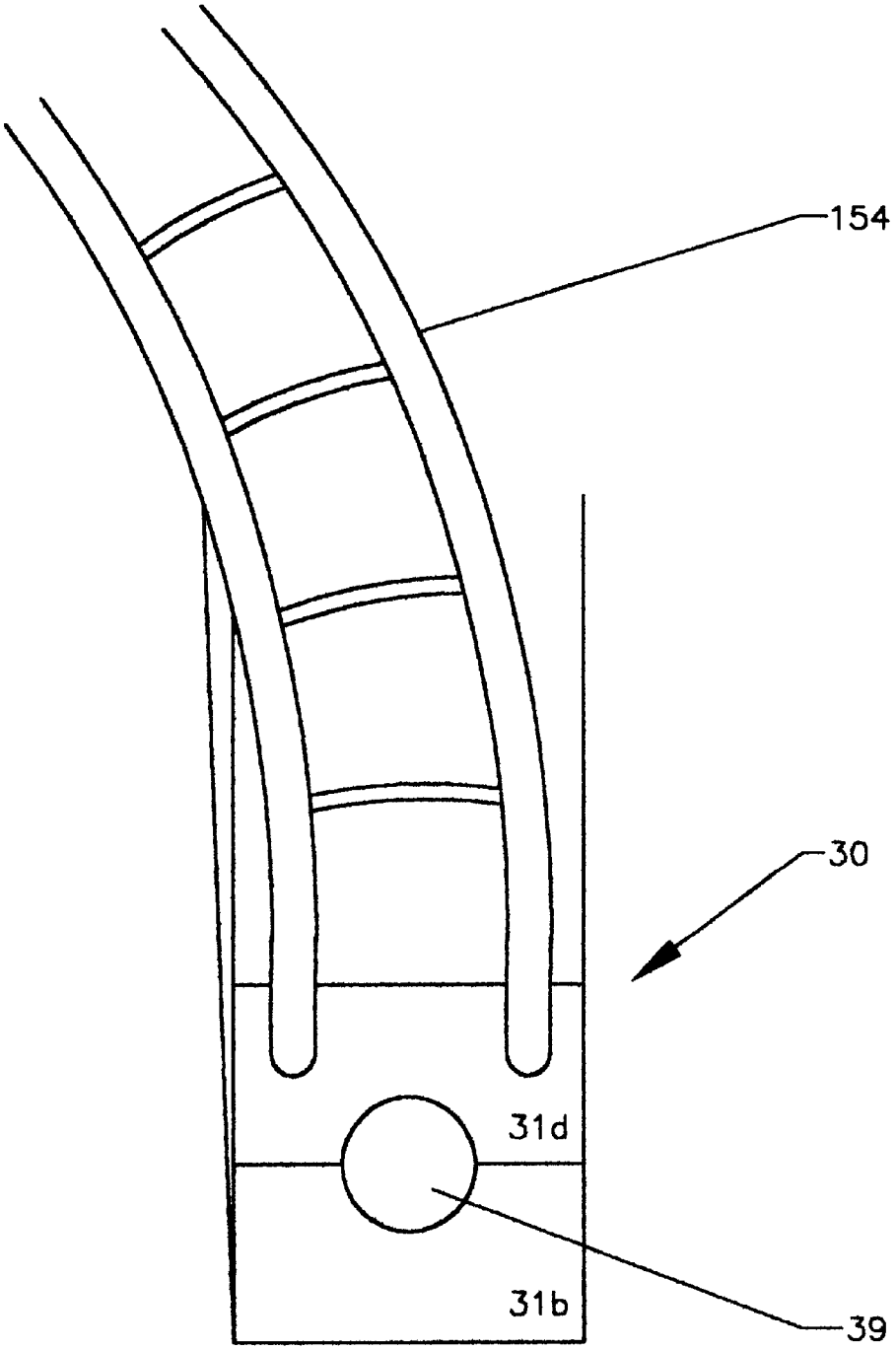
FIG. 2D is an isolated front view of a carton at the fitment application station of the mandrel assembly of FIG. 2.

FIG. 2D shows a carton 30 at the fitment application station 150. The carton 30 is positioned to receive a fitment from the fitment dispenser 154. In this embodiment, the fitment dispenser 154 is a chute mechanism connected to a fitment supply 155, not shown, on one end and terminating at the fitment application station 150 on the other end. The fitment dispenser 154 will, if necessary, also orient the fitments 160 for proper placement on the carton. One orienting device for fitments is disclosed in co-pending U.S. patent application Ser. No. 08/996,606, entitled Orienting Apparatus For An Orientationally Sensitive Closure, filed on Dec. 23, 1997, and which relevant parts are hereby incorporated by reference.

In a preferred embodiment, as illustrated in FIG. 2E, the fitment application station 150 includes an ultrasonic horn unit 152, means for moving the horn 153, not shown, and the fitment dispenser 154. The fitment dispenser 154 delivers fitments 160 from the fitment supply 155 to a position for placement on the top sealed end of the carton 30. The fitments 160 are continuously supplied during the top sealing operation. Once the fitment 160 is placed upon the carton, the horn 152 is moved toward the mandrel 100 for ultrasonic sealing of the fitment 160 to the top sealed end of the carton 30. The ultrasonic horn unit 152 has a recess 159 in its sonotrode for receiving the fitment 160. The recess 159 is sized to accommodate the configuration of the fitment 160 for proper sealing. Thus, fitments of different configurations will necessitate a recess 159 having an appropriate configuration. As shown in FIG. 2E, the mandrel 100 acts as an anvil during the fitment welding operation to receive the ultrasonic energy from the sonotrode.

The fitment dispenser 154*a* of FIG. 2F is an alternative that may be employed at the fitment application station 150. The oscillating picker 161 picks fitments 160 from the dispenser 154 and transports the fitments 160 to the mandrel 100 with a carton 30 thereon. The oscillating picker 161 may be oscillated by a cylinder, or controlled by a servomotor, both not shown.

In an alternate embodiment, the fitment 160 may be applied to the carton 30 through induction heat sealing. In such an embodiment, the carton blank usually includes at least one aluminum layer. In this embodiment, an inductor mounted on a moving means would be substituted for the horn 152. A further description of an induction heat sealing system is described in co-pending U.S. patent application Ser. No. 09/127,270, filed on Jul. 31, 1998, entitled Induction Heat Sealing Of A Closure To A Container, which relevant parts are hereby incorporated by reference.

In yet another embodiment of the fitment application station 150, a hot melt applicator is utilized to apply the fitment 160 to the carton 30. One example of such a hot melt applicator is described in U.S. Pat. No. 5,429,699, entitled Method And Apparatus For Attaching A Spout To A Carton, which relevant parts are hereby incorporated by reference.

Once the sealing operation is completed, the carton and mandrel are rotated to the discharge station 170. At the discharge station 170, the carton is pulled off of the mandrel 100 and placed on a carton path 172 defined by continuous chains 174*a–b*. The partially-formed carton 30 is pulled from the mandrel 100 by means of a discharge device 173 which is vertically displaceable and has at its front part a suction or gripping device the grips the partially formed carton 30. The discharging operation is effected by raising the discharging device 173 with the aid of an actuator 179, not shown, until its suction or gripping head 181 comes into contact with the top of the partially formed container 30. When the discharge device 173 moves downward, the partially-formed container 30 is pulled from the mandrel 100 and lowered between into a carton pocket which are arranged on an intermittently movable conveyor system 180.

As shown in FIGS. 4 and 4A, the conveyor system 180 includes the two continuous chains 174*a–b* which are each rotated by drums 175*a–b* to define the carton path 172. Each of the chains 174*a–b* have a plurality of carton guides 177 which define each carton pocket where upon each carton 30 rests during transport on the conveyor system 180. Two support rods 182*a–b* are disposed below the carton path 172 to allow for the fitment to rest therebetween while each carton is transported to the other stations on the packaging machine 22. The support rods 182*a–b* are positioned above the table top 190 of the packaging machine 22. The table top 190 divides the processing stations from the motors and other interworkings of the packaging machine 22.

As shown in FIG. 1, two or more mandrel wheels 105 may be simultaneously associated with a single conveyor system 180, thus discharging two or more partially-formed cartons 30 to the conveyor 180 for transport to further stations for processing. This necessitates further duplication of all of the processes downline such as two filling pipes and two bottom sealers. Also, movement of the conveyor would be indexed to two container lengths, or if more cartons 30 were placed on the conveyor system 180 simultaneously, then the conveyor system 180 would be indexed to that number of carton lengths.

Once the partially-formed cartons 30 are discharged to the conveyor system 180, the cartons 30 may be sterilized at a sterilization station before filling. Several examples of sterilization stations are set forth in U.S. Pat. No. 5,433,920 and co-pending U.S. patent application Ser. No. 08/911,967 filed on Aug. 15, 1997 for an UV Radiation And Vapor-Phase Hydrogen Peroxide Sterilization Of Packaging which relevant parts are hereby incorporated by reference.

The cartons 30 are then conveyed to a filling station wherein a filling device fills each inverted partially-formed carton 30 from the open bottom. The inverted carton 30 may be raised about a filling tube by a lifting mechanism and gradually lowered as the inverted carton 30 is filled.

Next, the filled carton 30 is conveyed to a heating station where the bottom end panels are disposed directly below a heating device. The heating device consists of a pair of plates having a plurality of holes therein whereby heated air is blown through the holes which are arranged in a pattern which directs the heat air to primarily only those parts of the bottom end panels which are intended to be sealed against one another. The coating layer (whether PE, PET, EVOH, PP or the like) is heated to the point of plastification whereupon the cartons 30 are conveyed to a sealing station where the bottom end panels are finally folded and sealed to form a fully fabricated carton 30. The cartons 30 are then discharged from the machine, or inverted then discharged for subsequent transport and distribution.

Due to the folding arrangement of the bottom of the cartons 30, it might be necessary to rotate each carton 30 prior to bottom sealing, and even prior to filling. Such a rotation may be effected by lifting each carton 30 above the conveyor assembly, and then rotating each carton ninety degrees to coordinate the bottom sealing with the orientation of a post-filling sealing device of a conventional packaging machine. The rotation may occur at a station prior to filling to prevent sloshing of the product within the carton 30. Alternatively, the rotation could occur subsequent to filling, with the product within the carton 30. Yet another embodiment may have the mandrel 100 rotate ninety degrees prior to placement of each carton 30 on the conveyor assembly.

There is illustrated in FIGS. 5–9 cartons 30 with various fitments 160 thereon to demonstrate the capabilities of the present invention. Of particular note is the diameter of the fitment, especially the flange 300 and the cap 302 of the fitment 160. Both the flange 300 and the cap 302 are oversized and are incapable of being inserted through an aperture in the carton as is the conventional form of applying a fitment to a carton. If the aperture would be made large enough to insert these "oversized" fitments therethrough, then there would be little area on the top of the carton for attachment of the flange thereto.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A packaging machine for fabricating a container, the container having a plurality of side panels, a top end defined by top panels and a bottom end defined by bottom panels, the packaging machine comprising:

means for erecting a container blank to a partially-formed container;

at least one mandrel projecting outward from a mandrel wheel, the mandrel wheel rotating about a fixed axis; the mandrel having a body and a projection end, the projection end opposite an end of the mandrel attached to the mandrel wheel;

a folding device for folding the top panels of the partially-formed container to break a plurality of crease lines defining the top panels from the side panels of the partially-formed container, the folding device disposed along the rotation of the mandrel wheel;

a heating device for heating the top panels of the partially-formed container, the heating device disposed subsequent to the folding device along the rotation of the mandrel wheel;

a press for sealing each of the plurality of top panels to each adjacent top panel, the press disposed along the rotation of the mandrel wheel and capable of an oscillating motion toward and away from the projection end of the mandrel;

means for applying a fitment to the partially-formed container; and a supply of fitments connected to the fitment application means.

2. The packaging machine according to claim 1 wherein the fitment application means is disposed subsequent to the press, the application means applying the fitment to the exterior surface of the top of the partially-formed container.

3. The packaging machine according to claim 1 further comprising means for discharging a container from the mandrel and onto a conveyor assembly for further processing on the packaging machine.

4. The packaging machine according to claim 3 wherein the discharge means is a gripping device for pulling the partially-formed container off the mandrel.

5. The packaging machine according to claim 1 wherein the application means is an ultrasonic welder for welding the fitments to the partially-formed container.

6. The packaging machine according to claim 1 wherein the fitment application means is an induction heating assembly.

7. The packaging machine according to claim 1 wherein the fitment application means is a hot melt assembly.

8. The packaging machine according to claim 1 further comprising a bottom sealing device disposed subsequent to a filling station.

9. The packaging machine according to claim 1 wherein the supply of fitments is connected to the fitment application means by an orienting chute wherein fitments are delivered from the supply of fitments to the fitment applications means and positioned for attachment to the top of the carton.

10. A method for attaching a fitment to the top of a carton, the carton having a plurality of top panels that form the top of the carton, the method comprising:

placing an erected carton blank onto a mandrel, the mandrel connected to a mandrel wheel assembly which rotates about a fixed axis, the mandrel having a projection end opposite the attachment to the mandrel wheel assembly;

heating the plurality of top panels at a heating station one indexed movement of the mandrel wheel assembly away from the placement of the erected carton blank onto the mandrel;

pressing the plurality of top panels onto each other at a pressing station one indexed movement of the mandrel wheel assembly away from the heating station, the pressing of the plurality of top panels forming the top of carton with an access area therein for placement of a fitment thereabout;

delivering a fitment from a fitment supply to a fitment application station, the fitment application station one indexed movement of the mandrel wheel assembly away from the pressing station; and applying the fitment to the top of the carton about the access area at the fitment application station.

11. The method according to claim 10 wherein the fitment application station comprises an ultrasonic welding assembly for attaching the fitment to the carton.

12. The method according to claim 10 wherein the fitment application station comprises an induction heating assembly for attaching the fitment to the carton.

13. The method according to claim 10 wherein the fitment application station comprises a hot melt assembly for attaching the fitment to the carton.

14. The method according to claim 10 further comprising discharging the carton from the mandrel at a discharge station one indexed movement of the mandrel wheel assembly away from the fitment application station.

* * * * *